US008302662B2

(12) United States Patent
Kawa et al.

(10) Patent No.: US 8,302,662 B2
(45) Date of Patent: Nov. 6, 2012

(54) CONTINUOUS CASTING PLANT PARTICULARLY FOR LONG STEEL PRODUCTS, AND A METHOD FOR CONTINUOUS CASTING

(75) Inventors: Franz Kawa, Adliswil (CH); Christian Dratva, Zurich (CH)

(73) Assignee: SMS Concast AG, Zurich (CH)

( * ) Notice: Subject to any disclaimer, the term of this patent is extended or adjusted under 35 U.S.C. 154(b) by 34 days.

(21) Appl. No.: 12/810,420

(22) PCT Filed: Jan. 14, 2008

(86) PCT No.: PCT/EP2008/000249

§ 371 (c)(1),
(2), (4) Date: Jun. 24, 2010

(87) PCT Pub. No.: WO2009/089843

PCT Pub. Date: Jul. 23, 2009

(65) Prior Publication Data

US 2010/0276110 A1 Nov. 4, 2010

(51) Int. Cl.
*B22D 27/04* (2006.01)

(52) U.S. Cl. ..... 164/348; 164/454; 164/155.3

(58) Field of Classification Search ..... 164/454, 164/348, 155.3

See application file for complete search history.

(56) References Cited

U.S. PATENT DOCUMENTS

| | | | | |
|---|---|---|---|---|
| 4,485,837 | A * | 12/1984 | Wiesinger et al. | 164/448 |
| 4,488,591 | A | 12/1984 | Hoffmann et al. | |
| 4,703,792 | A * | 11/1987 | Colombo et al. | 164/442 |
| 5,630,467 | A * | 5/1997 | Yoshimura et al. | 164/486 |
| 6,892,794 | B2 | 5/2005 | Zajber et al. | |

FOREIGN PATENT DOCUMENTS

| | | |
|---|---|---|
| CA | 1204574 A1 | 5/1986 |
| EP | 1475169 A1 | 10/2004 |

* cited by examiner

*Primary Examiner* — Jessica L. Ward
*Assistant Examiner* — Nicholas D'Aniello
(74) *Attorney, Agent, or Firm* — Brian Roffe

(57) ABSTRACT

A continuous casting plant in particular for long steel products is provided with a mould (1), from which a cast strand (2) is continuously cast. The cast strand (2) is guided along a, in particular curved, guideway formed by guide rollers (11, 12, 13, 14) arranged one after the other, and at the same time in a cooling chamber having spray members. The guide rollers (12, 13, 14) and/or the spray members are contained in a plurality of centring modules (10) or spray modules (3) arranged one after the other and are adjustable in a controlled manner substantially concentrically with respect to the desired axis of the cast strand. As a result, on the one hand, the risk of thermally overloading the rollers and damaging the strand surface is considerably reduced and symmetrical cooling is ensured.

16 Claims, 3 Drawing Sheets

Figure 1:
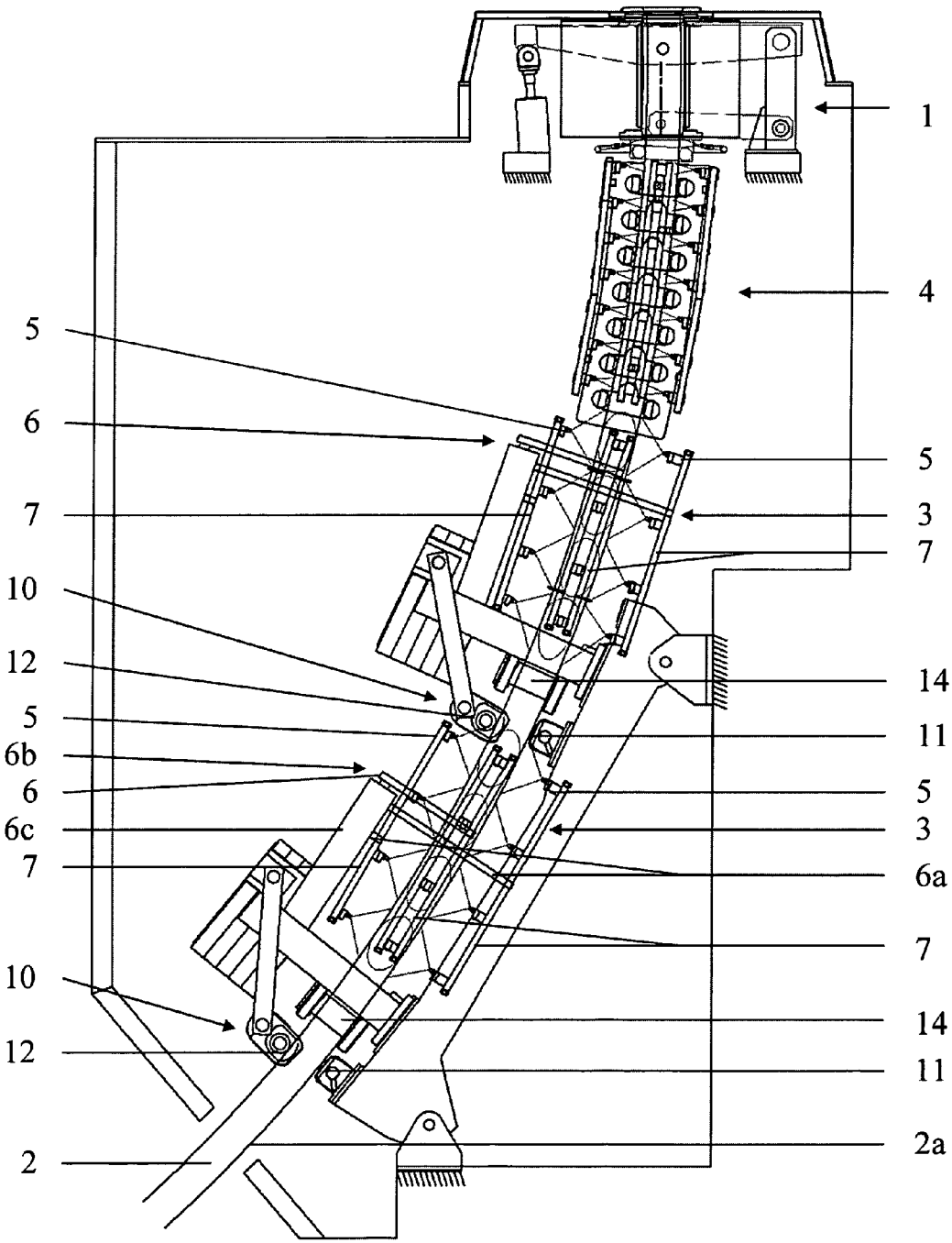

CONTINUOUS CASTING PLANT PARTICULARLY FOR LONG STEEL PRODUCTS, AND A METHOD FOR CONTINUOUS CASTING

The invention relates to a continuous casting plant, in particular for long steel products, having a mould, from which a cast strand is continuously cast, which strand is guided along a guideway formed by guide rollers arranged one after the other, and at the same time in a cooling chamber having spray members, and to a method for continuous casting in particular of long steel products, in which the liquid steel is poured into a mould and at the bottom is continuously withdrawn from this mould, with formation of a shell, as the cast strand, this cast strand being guided along a guideway formed by guide rollers arranged one after the other and in the process being further cooled by being subjected to the action of coolants.

In continuous casting, as is known, the liquid metal, e.g. liquid steel, is poured into a cooled mould and at the bottom is continuously led away from this mould, with formation of a shell, as a cast strand. This cast strand is guided through a further cooling device, a so-called secondary cooling, along a guideway formed by guide rollers arranged one after the other and in the process further cooled by being subjected to the action of coolants (spraying on water, water/air mixture) as well as contact with the guide rollers and also by radiation of the heat.

For reasons of quality, it is important that the cast strand is cooled symmetrically with regard to its cross-section. For this purpose, on the one hand the cooling nozzles must be precisely positioned and oriented and also have identical spray characteristics, but on the other hand exact guidance of the cast strand along its guideway is also important. As soon as an unsymmetrical temperature field arises in the cast strand for whatever reason, the strand tends to deviate, for example, laterally from the guideway owing to thermal deformation. This displacement leads immediately to uneven application of the cooling water agent and thus to further displacement of the strand from its desired position. The problem becomes particularly critical when small-format strands (billets, approx. 100-160 mm square) are cast using high-intensity spray water cooling, so-called hard cooling. Furthermore, when casting billet strands, it can happen that the strand lifts off from its curved guideway if increased frictional forces occur in the region of the mould, and in the process the relatively flexible strand is stretched as it were.

To guide the strand through the cooling device, use is made of guide rollers which are mounted fixedly or flexibly (via spring assemblies, compressed-air bellows etc.) at a predetermined minimum spacing from the strand, the flexible design being used in practice only at the upper side of the strand.

With these solutions, it is disadvantageous that most rollers stick after a short time owing to the highly corrosive and moist environment of the cooling chamber, since they are only sporadically touched by the strand and rotated by the latter, so that corrosion products and limescale deposits can quickly build up at the bearings. Sticking rollers are, on the one hand, thermally overloaded owing to the heat radiation of the strand and, on the other hand, they frequently damage the strand surfaces with scores and longitudinal scratches, which lead to rejects. Moreover, if strands with cross-sectional formats of different sizes are cast in the same continuous casting plant, in each case either completely new guide elements have to be installed or guide rollers have to be moved to a new position. Both of these measures involve expenditure of time and adversely affect the availability of the casting plant. In practice, therefore, the guide rollers are frequently set to the largest format, and the smaller formats are guided by them only in wide limits.

When casting faults occur, e.g. strand break-outs, fixedly positioned guide rollers and spray battens make it difficult to remove the broken-out strand, and restoration of the readiness for operation is time-consuming.

The object on which the present invention is based is to provide a continuous casting plant of the type mentioned at the outset and to propose a method for continuous casting in particular of steel, which are able to considerably improve the quality of the cast strand by precise cooling distributed symmetrically with regard to the strand cross-section. In addition, the idle times when converting the casting plant to another casting format and during maintenance are reduced.

This object is achieved, according to the invention, by a continuous casting plant having having a mould from which a cast strand is continuously cast, and at least one module in which the cast strand is guided along a curved guideway formed by guide rollers arranged one after the other and in a cooling chamber, and wherein the guide rollers include at least a first fixedly mounted guide roller arranged on a radially outermost side of the curved guideway and adapted to be situated on a first side of the cast strand, and at least second, third and fourth guide rollers each adapted to be situated on a respective side of the cast strand other than the first side of the cast strand. Respective actuating members adjust the second, third and fourth guide rollers in an approximately perpendicular direction to the respective side of the cast strand such that the second, third and fourth guide rollers are adapted to be continuously in contact with the cast strand. The actuating members enable a contact force of the respective guide rollers against the respective side of the cast strand to be adjustable, and the contact force of the guide roller against the respective side of the cast strand is measured.

Further preferred configurations of the continuous casting plant according to the invention and of the method according to the invention are described below.

In the case of the continuous casting plant according to the invention having a plurality of centring modules which are arranged one after the other and each of which has a fixedly mounted roller, defining the desired course of the guideway, for one strand side and further guide rollers for the other strand sides, the further guide rollers being adjustable in a substantially perpendicular direction to the corresponding cast strand surfaces and the contact pressure of the respective roller against the cast strand being adjustable, it is ensured that the guide rollers continuously run along with the strand owing to the clamping of the latter, and the cast strand is held in its desired position in the guideway. As a result, on the one hand, the risk of thermally overloading the rollers and damaging the strand surface is considerably reduced and symmetrical cooling is ensured.

Furthermore, the contact pressure of the strand against the centring rollers can be measured and a signal derived therefrom can be delivered to a control device, For example, in the event of an increase in force on the lateral rollers due to a thermally induced deformation of the cast strand, a targeted alteration of the cooling can be carried out locally, for example at a particular strand side, so that centred running of the strand is achieved by thermal means as it were.

Likewise, from the increase in the strand contact force against the upper centring rollers as the billet strand moves along its curved guideway, it is possible to draw conclusions about the strand withdrawal forces and thus the frictional forces in the region of the mould, thereby opening up new possibilities for the monitoring of the casting process, in particular of the mould friction.

The continuous casting plant according to the invention enables casting of strands with formats of various sizes without adversely affecting the availability of the plant, since it is not necessary to change the guide rollers and/or the spray members or manually reposition them in each case. At the same time, by virtue of the centred stand guidance, high production quality is ensured for all strand formats and the change-over times are considerably shortened.

Figure 2:
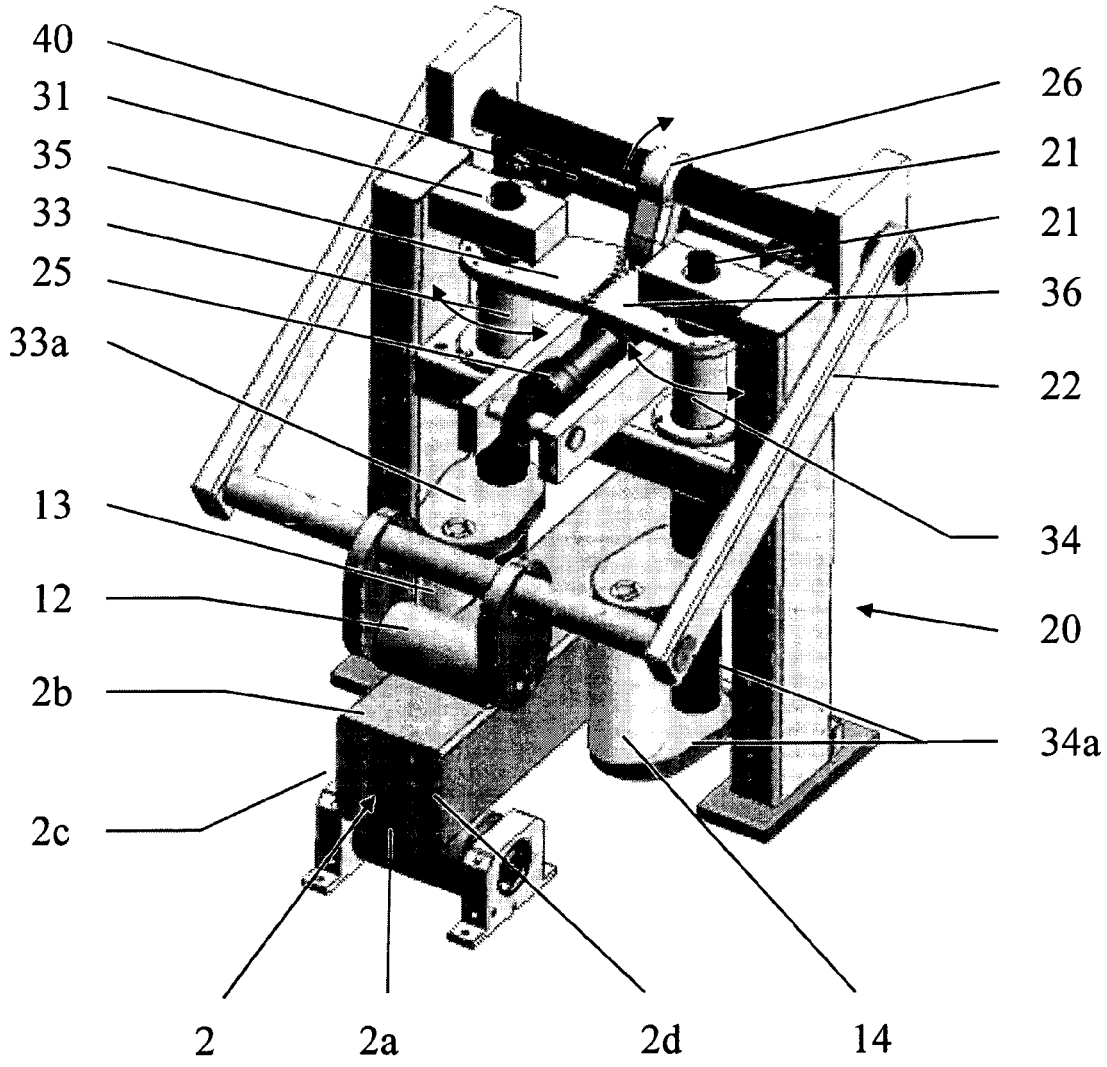
Figure 3:
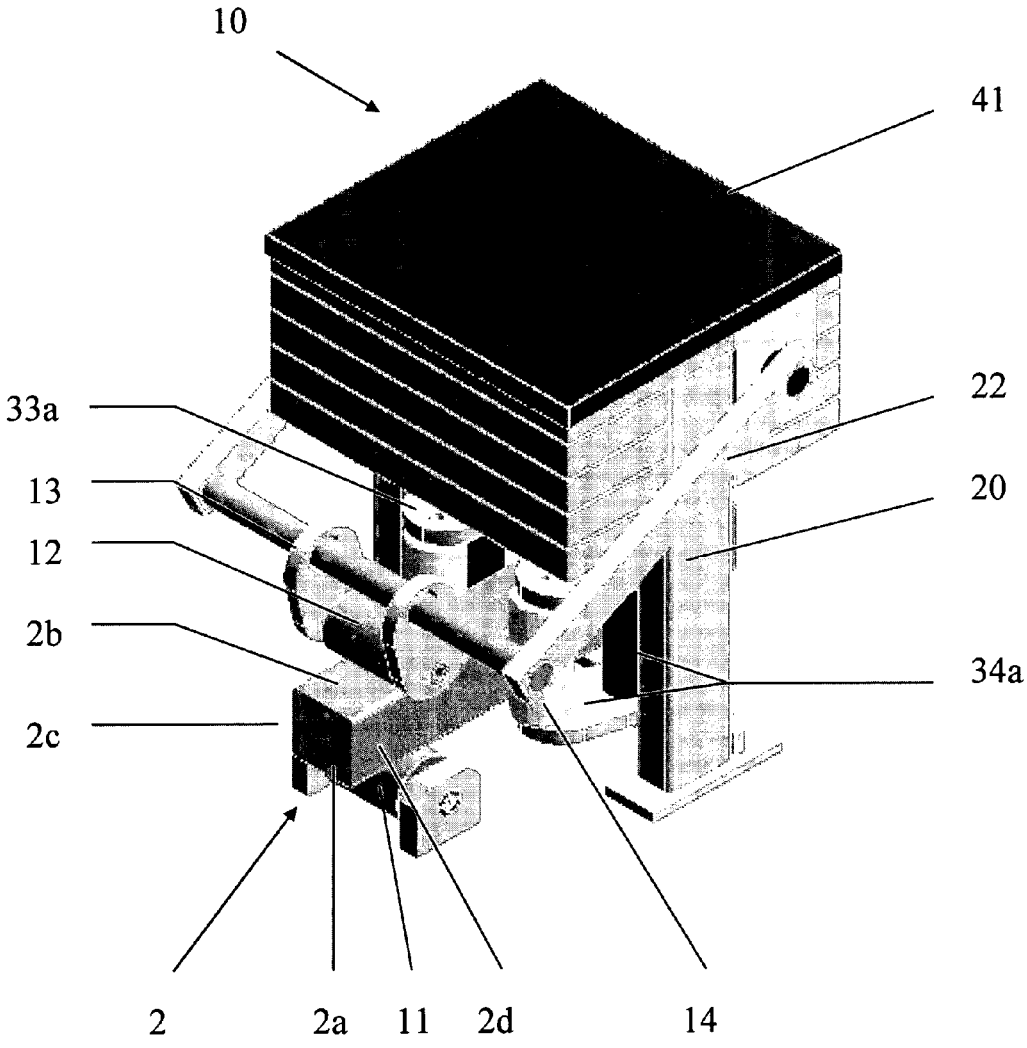

The invention is explained in more detail below with reference to the drawing, in which:

FIG. 1 schematically shows a side view of a part (mould with the following cooling chamber) of a continuous casting plant according to the invention;

FIG. 2 shows a perspective view of a centring module as part of the continuous casting plant according to FIG. 1; and FIG. 3 shows the centring module according to FIG. 2 with a protective box for a control device.

According to FIG. 1, a continuous casting plant comprises a mould 1, into which the liquid metal, in particular steel, is poured and at the bottom is continuously led away from this water-cooled mould 1, with formation of a shell, as a cast strand 2. This cast strand is guided through a further cooling device, a so-called secondary cooling, and in the process further cooled. Supporting rollers and spray members 4 as so-called foot roller stands or supporting segments may be installed at the mould outlet, as required. These are format-dependent and are exchanged with the mould each time the casting format is changed.

The cooling device comprises a plurality of spray modules 3 arranged one after the other, in which the cast strand 2, which is guided along a guideway, is subjected to the action of coolants, generally water or a water/air mixture. For this purpose, each cooling module 3 is equipped with a large number of spray nozzles 5, embodied as spray members, which are preferably mounted in water-conveying spray battens 7. The spray battens 7 are adjustable in a controlled manner substantially concentrically with respect to the axis of the cast strand via an adjusting member 6. As the adjusting member 6, advantageously pushing arms 6*a* are provided for the spray battens 7 at the inner and outer radius of the strand, and corresponding pivoting arms 6*b* are provided for lateral spray battens 7. In addition, a drive 6*c* connected to the pushing arms 6*a* and the pivoting arms 6*b* is provided for this adjusting member 6.

Under particular circumstances, in the case of so-called dry casting, the strand may, in contrast, be cooled without spray cooling, i.e. essentially only by means of water-cooled rollers. In this case, it is even more important for the strand to remain continuously in contact with all the guide rollers.

The cast strand 2 runs through a plurality of centring modules 10 arranged one after the other, each of which has a fixedly mounted roller 11, defining the desired course of the guideway, for one strand side 2*a* and further guide rollers for the other strand sides. These rollers can be seen in particular in FIGS. 2 and 3. In contrast to the roller 11, these further rollers 12, 13, 14 are arranged in a manner adjustable in a substantially perpendicular direction to the corresponding cast strand surfaces 2*b*, 2*c*, 2*d*, irrespective of the cross-sectional shape of the cast strand (square, rectangle, round, I-section, etc.), as will now be explained in the text which follows.

The respective centring module 10 has a stationary frame 20. One of the further guide rollers, the upper guide roller 12, is carried, by a U-shaped holder 22 pivotably held on the frame 20, in such a way that when it is pivoted it can be adjusted relative to the fixedly mounted roller 11 and in the process pressed against the strand side 2*b*. The pivoting of the holder 22 is preferably effected by means of a hydraulic cylinder 25, which can be seen in FIG. 2, via a lever 26 connected in a rotationally fixed manner to a pivot shaft 21. On adjustment of the hydraulic cylinder 25 and the lever 26, the pivot shaft 21 and with it also the U-shaped holder 22 are correspondingly pivoted.

The two remaining lateral guide rollers 13, 14 are carried by in each case one sleeve-shaped part 33, 34, pivotable about in each case one axle 31, 32 fixed to the frame, and to be precise via in each case two flange parts 33*a*, 34*a* which are connected to the respective part and in which the rollers are mounted. The two sleeve-shaped parts 33, 34 are rotationally connected to one another via interengaging toothed segments 35, 36. One of the two parts, according to FIG. 2 the part 34, is actuated or pivoted by a further hydraulic cylinder 40, its pivoting being transmitted via the toothed segments 35, 36 also to the other part 33, so that the two guide rollers 13, 14 can be adjusted via the pivotable flange parts 33*a*, 34*a* exclusively symmetrically to one another, i.e. concentrically with respect to the desired axis of the strand guideway, and can accordingly be pressed uniformly against the two strand side faces 2*c*, 2*d*.

The contact pressure of the guide rollers 12, 13, 14 is adjusted in a controlled manner via the two hydraulic cylinders 25, 40, and it is ensured that the guide rollers continuously run along with the strand. The risk of thermally overloading the rollers and of damaging the strand surface is thereby considerably reduced.

Furthermore, during casting operation, the current contact pressure can be measured and, in the event of a pressure increase due to a thermally induced deformation of the cast strand, a signal can be delivered to a control device, via which a targeted alteration of the cooling can be initiated and locally carried out, e.g. at a particular strand side, so that centred running of the strand is achieved by thermal means as it were.

An open-loop control or closed-loop control of the position and/or the contact force of the guide rollers 12, 13, 14 against the cast strand (2) may be provided, as required. In the case of a closed-loop control, this position and/or the contact force of the guide rollers may be adjusted by a comparison of the desired values with actual values.

It is also possible to fix a preset position of the centring rollers via a corresponding connection of the actuating members, for example by regenerative connection of the hydraulic cylinders, up to a very high, adjustable discharge force. This position may be checked at predetermined time intervals and corrected if required. This correction may be carried out either with open-loop control or even in the form of adaptive control, which can adapt to the local geometric requirements of the strand.

The aforementioned regenerative connection of the control cylinders is intended to mean a connection in which the two cylinder pressure chambers are connected via a line and the active contact force results from the rod area and the oil pressure. Only if the strand is about to deviate from the desired position, does the pressure on the piston side increase and the cylinder is blocked up to a predetermined maximum force.

As can be seen in FIG. 3, the adjusting members, preferably hydraulic cylinders 25, 40, and the control device are advantageously accommodated in a water-cooled, sealed box 41 above the guide rollers and are protected from the heat radiation and the corrosive environment.

The continuous casting plant according to the invention enables casting of strands with formats of various sizes without adversely affecting the availability of the plant, since it is not necessary to change the guide rollers or reposition them in each case. At the same time, high production quality is ensured for all strand formats.

It would be possible to couple the spray battens, fitted with spray nozzles, with the adjusting mechanisms of the guide rollers and thereby realise an automatic adjustment of the cooling members when changing formats, which would enable a quick, remote-controlled conversion of the casting plant to a new casting format.

The complete centring modules may be quickly installed in and removed from the cooling chamber by means of special manipulators positioned outside the cooling chamber. In this case, at the point of connection to the cooling chamber, each module may have a special connector unit, with the aid of which all media and signals can be automatically connected.

In principle, within the scope of the invention, it would also be possible, in a special plant, to provide only spray members according to the invention which are contained in a plurality of spray modules (3) arranged one after the other and are adjustable in a controlled manner substantially concentrically with respect to the axis of the cast strand, whereas the guide rollers would be arranged in the conventional way.

The invention claimed is:

1. Continuous casting plant having a mould from which a cast strand is continuously cast, and at least one module in which the cast strand is guided along a curved guideway formed by guide rollers arranged one after the other and in a cooling chamber the improvement comprising:

said guide rollers including at least a first fixedly mounted guide roller arranged on a radially outermost side of the curved guideway and adapted to be situated on a first side of the cast strand, and at least second, third and fourth guide rollers each adapted to be situated on a respective side of the cast strand other than the first side of the cast strand;

respective actuating members that adjust said second, third and fourth guide rollers in an approximately perpendicular direction to the respective side of the cast strand such that said second, third and fourth guide rollers are adjustable to be continuously in contact with the cast strand, said actuating members enabling a contact force of the respective one of said second, third and fourth guide rollers against the respective side of the cast strand to be adjustable, said actuating members of said third and fourth guide rollers each including a sleeve-shaped part that carries the respective one of said third and fourth guide rollers, each of said sleeve-shaped parts being pivotable about a respective axle fixed to said frame, said sleeve-shaped parts being rotationally connected to one another via interengaging toothed segments, a frame, said respective actuating member for said second guide roller including a U-shaped holder that carries said second guide roller, said U-shaped holder being pivotally mounted to said frame, a first hydraulic cylinder or actuator for pivoting said U-shaped holder or for pressing said second guide roller against the cast strand, and a second hydraulic cylinder or actuator for actuating one of said sleeve-shaped parts to enable symmetrical pivoting of said sleeve-shaped parts or for concentrically pressing said third and fourth guide rollers against the cast strand running in a desired position, the contact force of said second, third and fourth guide rollers against the respective side of the cast strand being measured.

2. Continuous casting plant according to claim 1, wherein said second, third and fourth guide rollers are adjustable concentrically with respect to a desired axis of the cast strand.

3. Continuous casting plant according to claim 1, further comprising adjustable spray members, adjustment of said spray members being coupled to adjustment of said second, third and fourth guide rollers.

4. Continuous casting plant according to claim 1, wherein said second guide roller is adjustable relative to said first fixedly mounted guide roller and said third and fourth guide rollers are adjustable concentrically with respect to a desired axis of the cast strand.

5. Continuous casting plant according to claim 1, wherein an open-loop control or a closed-loop control of the position and/or of the contact force of said second, third and fourth guide rollers against the cast strand is provided.

6. Continuous casting plant according to claim 1, wherein said first hydraulic cylinder or actuator is fixable by means of a control connection in a preset position of said second guide roller up to a very high adjustable limit force and said second hydraulic cylinder or actuator is fixable by means of a control connection in a preset position of said third and fourth guide rollers up to a very high adjustable limit force.

7. Continuous casting plant according to claim 1, wherein said first and second hydraulic cylinders are operatively connected to a control device and are arranged together with said control device in a water-cooled box above said first, second, third and fourth guide rollers.

8. Continuous casting plant according to claim 1, wherein said first, second, third and fourth guide rollers are contained in a centering module, said centering module being installable and removable from said cooling chamber.

9. Continuous casting plant according to claim 8, wherein, at a point of connection to the casting plant, said centering module has defined connector units that aid in connection of cooling and control media, and measuring and control signals upon installation of said centering module.

10. Continuous casting plant according to claim 1, further comprising:

spray battens;

spray nozzles mounted in said spray battens; and actuating members for adjusting said spray battens in an approximately perpendicular direction to sides of the cast strand.

11. Continuous casting plant according to claim 1, further comprising a control device for controlling cooling of the cast strand based on the measured contact force of said second, third and fourth guide rollers against the respective side of the cast strand.

12. Continuous casting plant having a mould from which a cast strand is continuously cast, which strand is guided along a curved guideway formed by guide rollers arranged one after the other, and at the same time in a cooling chamber having spray members, the improvement comprising:

said guide rollers including at least first and second guide rollers adapted to be situated each on a respective side of the cast strand;

a frame;

respective actuating members that adjust said first and second guide rollers in an approximately perpendicular direction to the respective side of the cast strand, said actuating members enabling a contact force of the respective one of said first and second guide rollers against the cast strand to be adjustable, said actuating members each including a sleeve-shaped part that carries the respective one of said first and second guide rollers, each of said sleeve-shaped parts being pivotable about a respective axle fixed to said frame, said sleeve-shaped parts being rotationally connected to one another via interengaging toothed segments;

a first hydraulic cylinder or actuator for actuating one of said sleeve-shaped parts to enable symmetrical pivoting of said sleeve-shaped parts or for concentrically pressing said first and second guide rollers against the cast strand running in a desired position;

at least one fixedly mounted guide roller arranged on a radially outermost side of the curved guideway and adapted to be situated on a side of the cast strand;

an additional guide roller adapted to be situated on another side of the cast strand;

an additional actuating member that adjusts said additional guide roller in an approximately perpendicular direction to the another side of the cast strand, said additional actuating member enabling a contact force of said additional guide roller against the another side of the cast strand to be adjustable, said additional actuating member including a U-shaped holder that carries said additional guide roller, said U-shaped holder being pivotally mounted to said frame;

and a second hydraulic cylinder or actuator for pivoting said U-shaped holder or for pressing said additional guide roller against the cast strand.

13. Continuous casting plant according to claim 12, further comprising adjustable spray members, adjustment of said spray members being coupled to adjustment of said first and second guide rollers.

14. Continuous casting plant according to claim 12, wherein said first guide roller is adjustable relative to said at least one fixedly mounted guide roller.

15. Continuous casting plant according to claim 12, wherein said first and second guide rollers are contained in a centering module, said centering module being installable and removable from said cooling chamber.

16. Continuous casting plant according to claim 12, further comprising:

spray battens;

spray nozzles mounted in said spray battens; and actuating members for adjusting said spray battens in an approximately perpendicular direction to sides of the cast strand.

* * * * *